United States Patent [19]

Bradshaw

[11] 4,196,744

[45] Apr. 8, 1980

[54] EXHAUST GAS RECIRCULATION CONTROL

[75] Inventor: Cyril E. Bradshaw, Kalamazoo, Mich.

[73] Assignee: Eaton Corporation, Cleveland, Ohio

[21] Appl. No.: 921,392

[22] Filed: Jul. 3, 1978

Related U.S. Application Data

[63] Continuation of Ser. No. 725,069, Sep. 21, 1976, abandoned.

[51] Int. Cl.[2] ..... F02M 25/06

[52] U.S. Cl. ..... 137/489; 137/492.5; 123/119 A

[58] Field of Search ..... 123/119 A; 137/489, 137/490, 315, 492.5; 92/98 R

[56] References Cited

U.S. PATENT DOCUMENTS

| | | | |
|---|---|---|---|
| 3,880,129 | 4/1975 | Hollis | 123/119 A |
| 3,978,880 | 9/1976 | Crown | 137/315 |

*Primary Examiner*—Alan Cohan

*Attorney, Agent, or Firm*—R. J. McCloskey; E. C. Crist; R. A. Johnston

[57] ABSTRACT

A valve assembly is provided for controlling the recirculation of exhaust gases in an internal combustion engine. The assembly includes a fixed body portion having an exhaust inlet and an exhaust outlet port and a moveable transducer portion. A diaphragm is attached to the body and transducer portions to define a vacuum chamber and an atmospheric chamber in the body portion and a second atmospheric or air bleed chamber and an exhaust chamber in the transducer portion. Passages integrally formed in the diaphragm at its point of attachment to the transducer portion provide fluid communication between the two atmospheric chambers. Valve means are provided between the transducer atmospheric chamber and the vacuum chamber and between the exhaust inlet and outlet ports. A valve stem is attached to the transducer portion through a novel crimped joint, and the exhaust port valve member is mounted to the stem in a manner providing flexibility in effecting seating engagement of the valve member with the main body portion. A bearing member supports the valve stem for axial movement and is secured to the main body portion by another novel crimped joint.

1 Claim, 5 Drawing Figures

FIG. 1.
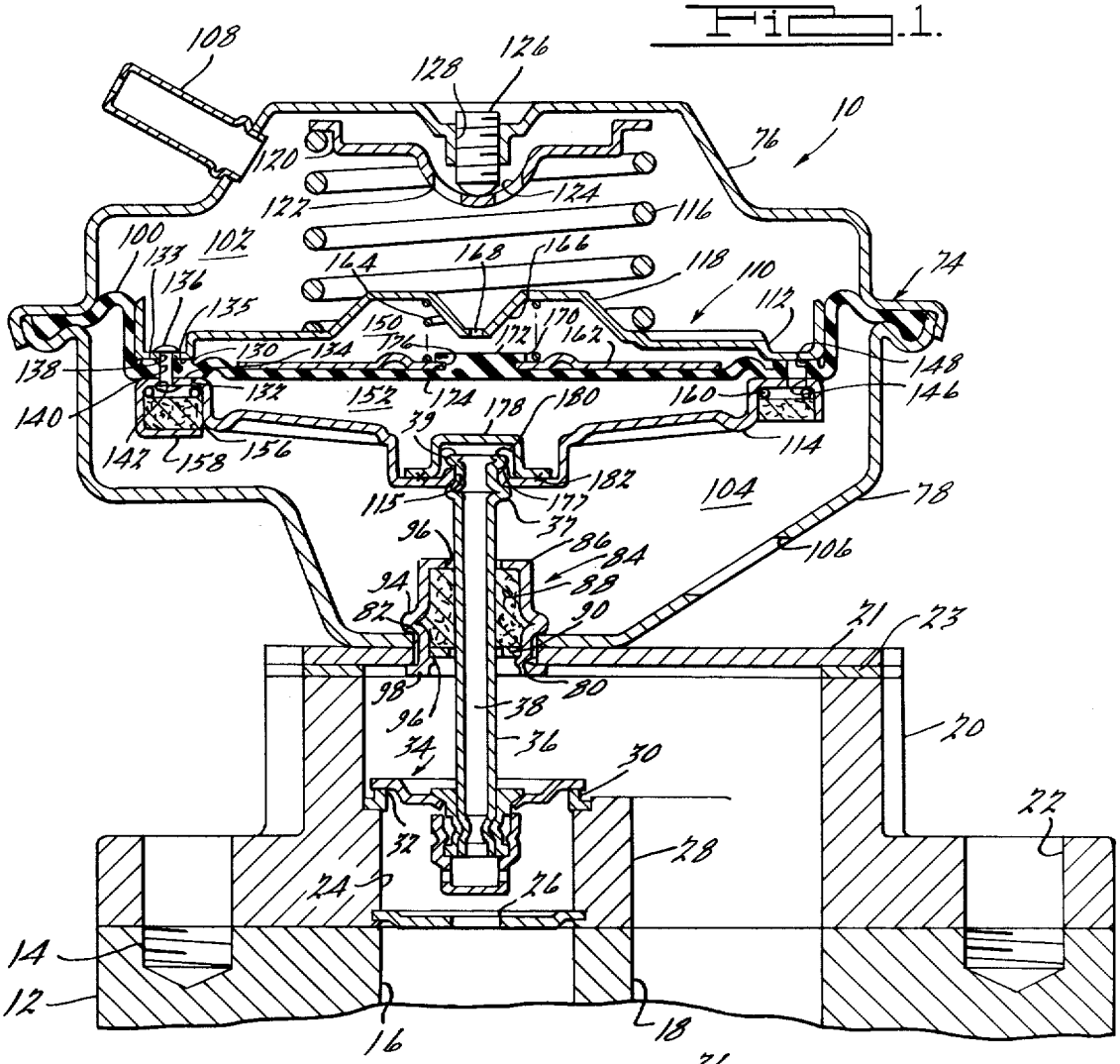
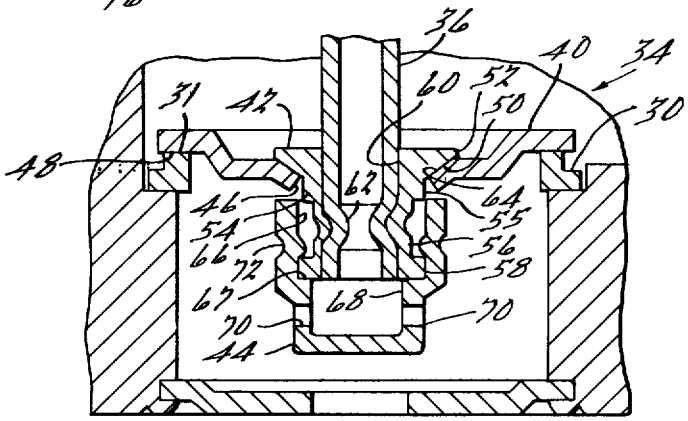
FIG. 2.

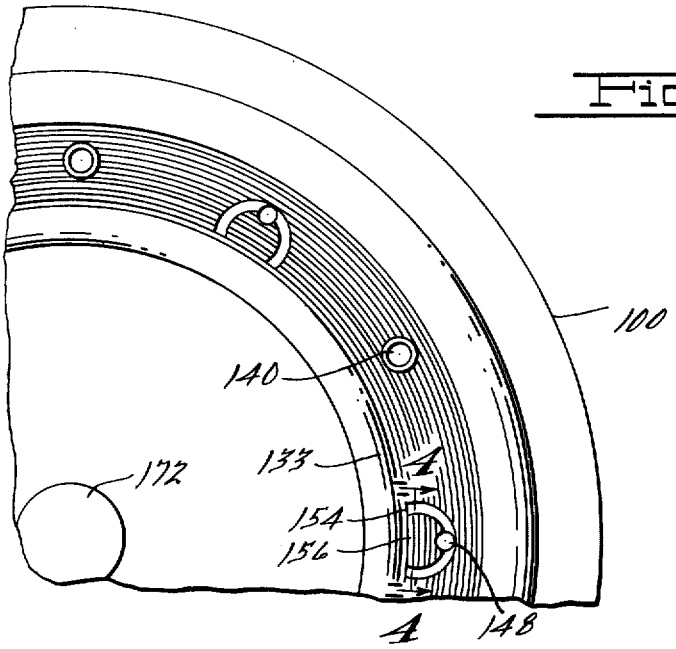
Fig. 3.
Fig. 4.
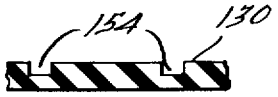
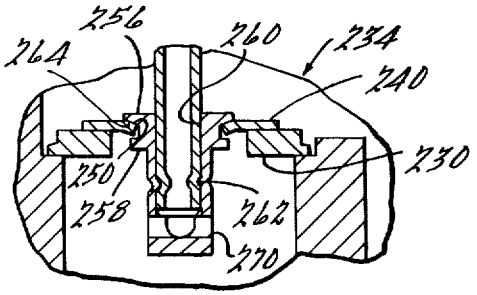
Fig. 5.

EXHAUST GAS RECIRCULATION CONTROL

This is a continuation, of application Ser. no. 725069, filed Sept. 21, 1976, now abandoned.

BACKGROUND OF THE INVENTION

1. Field of the Invention

The present invention relates generally to a valve assembly for recirculating exhaust gases in an internal combustion engine and more particularly to such a valve assembly which includes an exhaust gas back-pressure transducer.

2. Description of the Prior Art

Exhaust gas recirculation valves combined in an assembly with exhaust gas back-pressure transducers are known in the prior art. While the performance of these combination valves has been generally satisfactory certain disadvantages have been encountered in their manufacture and use.

One disadvantage has been the required use of complex, expensive structure to effect fluid communication between the air bleed chamber of the exhaust gas back-pressure transducer and the atmosphere. Combination valves have heretofore uneconomically utilized passages formed through a structural member of the transducer to effect this communication.

Another disadvantage has been noted in the construction of the poppet valve assembly through which the recirculating exhaust gas flows. Extreme care in the manufacture of this assembly has been required to prevent misalignment of the valve with respect to its seat which would result in unacceptably high leakage through the valve.

Still other disadvantages have been noted in the means previously employed to join portions of the valve assembly to each other. Threaded fasteners and weldments, for example, have been employed to join valve and control sections of the valve housing and to join the valve stem of the EGR valve to the pressure transducer.

SUMMARY OF THE INVENTION

Accordingly, it is an object of the present invention to provide an exhaust gas recirculation valve including an exhaust gas back-pressure transducer wherein simple economical means are employed to effect communication between the air bleed chamber of the transducer and the atmosphere.

It is another object to provide an exhaust gas recirculation valve including a recirculation poppet valve assembly tolerant of misalignment with respect to the exhaust gas inlet port of the valve.

It is yet another object to provide an exhaust gas circulation valve including an exhaust gas back-pressure transducer wherein simple, economical means are employed to secure components thereof together.

In accordance with one feature of the present invention an exhaust gas back-pressure transducer includes a pressure responsive member having passages formed through it to provide communication between the transducer air bleed chamber and the atmosphere.

In accordance with another feature, the invention exhaust gas recirculation valve is provided with a recirculation valve subassembly including self-aligning means.

BRIEF DESCRIPTION OF THE DRAWINGS

These and other objects and features will be apparent to those skilled in the art upon reading the following description with reference to the attached drawings in which:

FIG. 1 is a cross-sectional view of the valve assembly of the present invention;

FIG. 2 is an enlarged cross-sectional view of the exhaust valve subassembly;

FIG. 3 is a partial top sectional view with reference to FIG. 1 showing the passages formed in the upper surface of the diaphragm of the valve assembly;

FIG. 4 is a partial sectional view of the passages of FIG. 3 taken along line 4—4 thereof; and FIG. 5 is a cross-sectional view of an alternative embodiment of the exhaust valve subassembly of the invention valve assembly.

DESCRIPTION OF THE PREFERRED EMBODIMENT

Referring now to FIG. 1, the invention exhaust gas recirculation (EGR) valve assembly 10 is illustrated as being configured for mounting on a manifold boss portion 12 of an internal combustion engine. The manifold boss portion includes a plurality of bolt receiving bores 14, an exhaust passage 16 providing pressurized fluid communication with the engine exhaust manifold, and an intake passage 18 for directing recirculated exhaust gas to the engine intake manifold.

The EGR valve assembly 10 includes a valve housing 20 which includes a plurality of bolt receiving bores 22 aligned with the bores 14 of manifold boss portion 12. The valve housing 20 further includes an exhaust gas inlet 24 in open communication with the exhaust passage 16 through an orifice 26 and an exhaust gas outlet 28 directly communicating with the intake passage 18. A seat member 30 is fixedly secured to the valve housing 20 at the upper end (as viewed in FIG. 1) of the exhaust gas inlet 24 to define an EGR orifice 32 with a recirculation valve subassembly 34 which is carried for axial movement with a hollow tubular valve stem member 36 which has an axially extending exhaust passage 38 formed therethrough.

The recirculation valve subassembly 34 as may best be seen in FIG. 2 includes a sealing plate 40, a hub member 42, and a baffle shell member 44.

Sealing plate 40 is a generally disc shaped member including a central aperture 46, a flat lower surface 48 formed adjacent its outer periphery for sealingly engaging a flat upper surface 31 of the seat member 30. In the preferred embodiment of FIGS. 1 and 2 a sealing surface 50 is formed adjacent the central aperture 46 and is defined by a spherical radius substantially greater than the largest cross-sectional dimension of the aperture 46.

The hub member 42 is a generally cylindrical member having an upper flange portion 52, a first stepped down body portion 54, a second stepped down portion 56, and a lower flange portion 58. An axially extending through bore 60 receives the valve stem member 36 in a slip fit relationship, and the hub member 42 is fixed thereto by staking or like means as indicated at 62 at second stepped down portion 56. Upper flange portion 52 includes a lower sealing surface 64 preferably defined by a spherical radius substantially equal to that defining the surface 50 of sealing plate 40. Outer diameter 55 of first stepped down portion 54 is sized to provide clearance with the aperture 46 of sealing plate 40.

Baffle shell member 44 is formed as a cup-shaped member having a first bore 66 extending axially from its open end and being sized to closely fit the outer diameter 55 of first stepped down portion 54 to form with the diameter 55 and the hub member upper flange portion 52 a circumferentially extending groove for receiving the sealing plate 40. The bore 66 terminates in a shoulder 67 which abuts lower flange portion 58 at assembly, as shown in FIG. 1. A second, blind bore 68 extends downward from the bore 66 and is intersected by transverse baffle passages 70. Axial retention of shell member 44 is effected in the preferred embodiment by staking the shell member 44 at 72 above the lower flange portion 58.

The upper end of the valve housing 20 is closed by a cover plate 21 and a gasket member 23 joined thereto by suitable fasteners (not shown). Attached to the upper surface of the cover plate 21 is a control housing 74 having a control housing upper portion 76 and a control housing lower portion 78. Aligned bores 80, 82 are formed through the control housing lower portion 78 and the cover plate 21, respectively, to receive a guide subassembly 84 which slidingly receives the valve stem member 36.

The guide assembly 84 comprises a guide shell member 86, a bearing member 88, and a retaining washer 90. Guide shell member 86 is fabricated as a generally cup-shaped drawn member including a central through bore 92 providing clearance with respect to the valve stem member 36 and a collar 94 formed as a bead thereon having an outer diameter larger than the diameter of the through bore 80. The bearing member 88 is formed in a hollow, tubular configuration from a high temperature bearing material such as that manufactured by the Union Carbide Company under the trade name "Grafoil" and is press fit into the shell member 86 in the position shown. The bearing member 88 is retained in the fully bottomed axial position shown in FIG. 1 by the retaining washer 90, the position of which is fixed by staking the guide shell member 86 at 96. The open end of the guide shell member 86 is crimped to provide a retaining flange 98 abutting the lower surface of the cover plate 21 so that the guide subassembly 84, the control housing lower portion 78, and the cover plate 21 are axially retained as shown in FIG. 1. During this assembly operation, the inner diameter of the bearing member 88 is maintained at a dimension allowing free sliding receiving of the valve stem member by use of a supporting mandrel.

Disposed between and sealingly engaging control housing upper and lower portions 76, 78 is a pressure responsive member, a flexible diaphragm 100 which thereby divides the control housing 74 into an upper vacuum chamber 102 and a lower atmospheric chamber 104 in communication with atmospheric air through openings 106. Vacuum chamber 102 is in communication with a vacuum source through a vacuum fitting 108.

Diaphragm 100 is also attached to an exhaust gas back-pressure transducer assembly 110, being clamplingly secured between an upper housing shell 112 and a lower housing shell 114 thereof. The diaphragm 100 and the transducer assembly 110 are biased downward by a biasing spring 116. The spring 116 is seated at its lower end on the upper surface of upper member 112 and piloted about an upward protrusion 118 formed thereon. The spring 116 is seated at its upper end on a seat member 120 which includes a plurality of vacuum passages 122 formed therethrough. Seat member 120 further includes a centrally located concave upward portion 124 illustrated as defined by a spherical radius. The portion 124 abuts an adjusting screw 126 having a spherical end and threadedly received in a threaded bore 128 in control housing upper portion 76.

Returning now in greater detail to the construction of transducer subassembly 110, the diaphragm 100 includes an annular sealing portion 130 having a serrated lower surface 132 which abuts an upper surface 134 of transducer lower member 114 and a serrated upper surface 133 which abuts a lower surface 135 of upper member 112. The transducer subassembly 110 is thereby divided into an upper bleed air chamber 150 and a lower exhaust gas chamber 152. A plurality of rivets 136 extend through bores 138, 140, 142 formed in upper member 112, annular sealing portion 130, and lower member 114 to compressively engage the diaphragm 100 between the transducer members 112, 114. Second sets of aligned bores 146, 148, as may be seen in FIGS. 1 and 2, are formed through the lower member 114 and the sealing portion 130, respectively. In the preferred embodiment of FIGS. 3 and 4 channel passages 154 are formed in the upper serrated surface 133 to provide communication between the bores 148 and the upper air chamber 150. Central rib sections 156 are preferably provided adjacent the channel passages 154 to prevent closure thereof upon effecting the clamped assembled configuration illustrated. Fluid communication of the bores 148 with atmospheric air is effected through the bores 146 and a filter 156 retained by tang portions 158 of the lower member 114 and spaced from the bores 146 by a wire spacer 160.

A reinforcing plate 162 is fixed to the upper surface of the diaphragm 100, and the diaphragm 100 and plate 162 are biased downward by a second biasing spring 164 seated at its lower end on the reinforcing plate 162 and at its upper end against transducer upper member 112, being there piloted about a downward extending protrusion 166.

A centrally located air bleed passage 168 is formed through the transducer upper member 112. A central raised control portion 170 is formed on the diaphragm 100 and includes an upper surface 172 registering with and maintained in spaced-apart relation with respect to the air bleed passage 168 in protrusion 166 by the opposed forces of the second biasing spring 164 and the exhaust gas pressure in the chamber 152. Control portion 170 further includes a circumferentially extending groove 174 for insertion in a bore 176 of diaphragm 100 whereby the movement of reinforcing plate 162 with respect to the diaphragm 100 is constrained. The gap between the upper surface 172 of control portion 170 and a lower surface 167 of the protrusion 166 is maintained within close tolerance to control the flow of air from the transducer air chamber 150 to the vacuum chamber 102 to regulate or modulate the level of vacuum therein.

Attachment of the transducer lower member 114 to the valve stem member 36 is effected in a simple, effective manner as follows: The transducer lower member 114 is formed to include a central bore 115 surrounded by an upward extending flange 177. Valve stem member 36 is formed as a hollow tube having a bead 37 formed proximate the upper installed end thereof. The upper end of the valve stem member 36 is inserted through the bore 115, the bead 37 abutting the bottom of lower member 114. The end of the valve stem member is then crimped to form a second bead 39 which sealingly engages the flange 177, axially retaining the valve stem member 36 and substantially preventing fluid communication between the transducer exhaust chamber 152 and the atmospheric chamber 104. A baffle plate 178 having apertures 180 is attached, as by welding at 182, to the lower member 114 to cover the open end of the valve stem member 36.

DESCRIPTION OF THE FIG. 5 EMBODIMENTS

Turning now to an alternative embodiment of the recirculation valve assembly 34 is illustrated as recirculation valve assembly 234. It differs essentially from the recirculation valve assembly 34 in two respects. First, the hub member 256 is configured as a cup-shaped member having transverse passages 270 intersecting its central bore 260 and having an intermediate flange portion 258 for retaining the sealing plate 240, duplicating the function of the baffle shell member 44 of the FIG. 1 embodiment. Second, sealing plate sealing surface 250 and hub sealing surface 264 are inexpensively formed as chamfers rather than spherical radii. It will be understood by those skilled in the art that either or both of these two differences may be incorporated in modifying the FIG. 1 embodiment.

OPERATION OF THE PREFERRED EMBODIMENTS

The operation of the invention exhaust gas recirculation valve may best be understood by reference to FIG. 1 in which the valve assembly is shown in its neutral position. In this position the sealing plate 40 engages the valve seat 30 and the central raised control portion 170 of the diaphragm 100 is approximately at its maximum separation from the air passage 168 formed through the protrusion 166 of the lower shell member 114. A predetermined vacuum level must be present in the vacuum chamber 102 in order to permit the atmospheric pressure in the chamber 104 to overcome the biasing force of the spring 116 to raise the transducer assembly 110 and consequently the valve stem member 36 and the recirculation valve subassembly 34 attached thereto. The vacuum level in the chamber 102 is in part determined by the vacuum source with which it is communicated through the fitting 108. In an internal combustion engine utilizing the invention exhaust gas recirculation valve that vacuum source may be maniford vacuum downstream of the throttle plate but is preferrably that that vacuum referred to as venturi suction, taken from a location in the carburetor which is closed by the butterfly valve of the carburetor. The position of the recirculation valve subassembly 34 is therefore seen to be directly responsive to induction passage vacuum levels in an engine.

Concurrently, the position of the control portion 170 of the diaphragm 101 is responsive to the level of the exhaust gas pressure. When the datum back pressure (dbp), i.e., the positive gauge pressure exerted by the exhaust gas in the exhaust gas inlet 16 is transmitted to the exhaust chamber 152 of transducer assembly 110, it exerts a positive pressure against the lower surface of the diaphragm 100 tending to urge the control portion 170 upward as viewed in FIG. 1. When the pressure exerted by the exhaust gas rises above a predetermined dbp level sufficient to overcome the downward force exerted by the spring 164 and by atmospheric pressure in the air bleed chamber 150 (which is in direct fluid communication with the chamber 104 through the passages 154, 148, 146 in diaphragm 101 and lower shell member 114 and through the filter member 156), the control portion 170 is moved to a position wherein it is closer to the air bleed passage 168, thereby restricting the flow of air from the air bleed chamber 150 to the vacuum chamber 102. This flow restriction reduces the pressure, i.e., increases the vacuum in the vacuum chamber 102 and is thus operative to move the recirculation valve subassembly 34 upward in the same manner that an increase in vacuum level at the vacuum source tends to do. As the recirculation valve subassembly 34 is moved upward, the sealing plate is removed from abutting engagement with the seat 30. This permits exhaust gas to pass from the exhaust gas inlet to the exhaust gas outlet.

From the foregoing it should be clear that the operation of the entire valve assembly is continuously responsive to changes in both the exhaust gas pressure and the vacuum level in the vacuum chamber 102. Thus if the exhaust gas pressure in the exhaust gas inlet 16 decreases as a result in the decrease of engine load or simply as the back pressure is relieved by the upward movement of the recirculation valve assembly 34, the control portion 170 tends to move toward the neutral position shown in FIG. 1. Movement toward this position permits an increase flow of air between the air bleed chamber 150 and the vacuum chamber 102 causing the absolute pressure in the vacuum chamber to increase, i.e., the vacuum level to decrease, so that the biasing spring 166 can move the transducer assembly 110 downward toward its neutral position. As the neutral position is reached, the sealing plate contacts the seat 30 and is permitted to self-align with respect to the valve stem member 36 by cooperation of the alignment surface 50 of the hub member 42 and the second sealing surface 64 of the sealing plate 40.

While the invention has been described in detail in only certain embodiments, those skilled in the art will recognize that modifications can be made thereto without departing from the spirit of the invention as defined in the appended claims.

What is claimed is:

1. A valve assembly for controlling the recirculation of exhaust gases in an internal combustion engine in response to the magnitude of the exhaust gas pressure thereof, the valve assembly comprising:

(a) housing means defining an exhaust gas inlet and an exhaust gas outlet;

(b) valve means operable to control flow from said inlet to said outlet;

(c) a movable pressure transducer assembly disposed within said housing and operably connected to said valve and having, (1) an upper housing shell, (2) a lower housing shell, (3) pressure responsive means defining with said upper housing shell an air bleed chamber including a flexible diaphragm having a peripheral rim portion disposed between said upper housing shell and said lower housing shell, said rim portion having an increased thickness in the region of said joining with said upper housing shell and said lower housing shell, (4) means defining an air bleed passage through said upper housing shell, (5) bleed valve means operatively connected to said pressure responsive means for controlling flow through said air bleed passage, and (6) means defining a passage therethrough for communicating said air bleed chamber with the atmosphere, said passage defining means including an upwardly extending passage through said lower shell communicating at the lower end thereof with the atmosphere, said passage defining means further including a first passage defined by said diaphragm and registering with said upward extending passage, said first passage extending upwardly through said diaphragm, said diaphragm and said upper housing shell cooperating to define a pair of second passages communicating with said first passage, each of said second passages extending radially inwardly from said first passage, said second passages defined by an arcuate groove formed on the upper surface of said peripheral rim portion of said diaphragm and bounded by the lower surface of said upper housing shell, said second passages each communicating with said air bleed chamber;

(d) means communicating said exhaust gas inlet pressure to said pressure responsive means for controlling said bleed valve means; and (e) means joining said diaphragm, said upper shell, and said lower shell.

* * * * *